US006227318B1

(12) United States Patent
Siracki

(10) Patent No.: US 6,227,318 B1
(45) Date of Patent: May 8, 2001

(54) SUPERHARD MATERIAL ENHANCED INSERTS FOR EARTH-BORING BITS

(75) Inventor: Michael A. Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/206,835

(22) Filed: Dec. 7, 1998

(51) Int. Cl.[7] ..... E21B 10/26
(52) U.S. Cl. ..... 175/430; 175/426; 175/434
(58) Field of Search ..... 175/426, 428, 175/430, 434

(56) References Cited

U.S. PATENT DOCUMENTS

| | | | |
|---|---|---|---|
| 4,148,368 | 4/1979 | Evans | 175/329 |
| 4,339,009 | 7/1982 | Busby | 175/374 |
| 4,359,335 | 11/1982 | Garner | 75/208 R |
| 4,629,373 | 12/1986 | Hall | 407/118 |
| 4,694,918 | 9/1987 | Hall | 175/329 |
| 4,722,405 | 2/1988 | Langford, Jr. | 175/374 |
| 4,832,139 | 5/1989 | Minikus et al. | 175/374 |
| 4,940,099 | 7/1990 | Deane et al. | 175/374 |
| 5,131,480 | 7/1992 | Lockstedt et al. | 175/374 |
| 5,172,777 | 12/1992 | Siracki et al. | 175/374 |
| 5,248,006 | 9/1993 | Scott et al. | 175/420.2 |
| 5,273,125 | 12/1993 | Jurewicz | 175/420.2 |
| 5,282,512 | 2/1994 | Besson et al. | 175/374 |
| 5,287,936 | 2/1994 | Grimes et al. | 175/331 |
| 5,322,138 | 6/1994 | Siracki et al. | 175/374 |
| 5,341,890 | 8/1994 | Cawthorne et al. | 175/374 |
| 5,351,770 | 10/1994 | Cawthorne et al. | 175/374 |
| 5,370,195 | 12/1994 | Keshavan et al. | 175/420.2 |
| 5,379,853 * | 1/1995 | Lockwood et al. | 175/428 |
| 5,379,854 | 1/1995 | Dennis | 175/434 |
| 5,469,927 | 11/1995 | Griffin | 175/432 |
| 5,499,688 | 3/1996 | Dennis | 175/426 |
| 5,542,485 | 8/1996 | Pessier et al. | 175/371 |
| 5,592,995 | 1/1997 | Scott et al. | 175/374 |
| 5,607,024 | 3/1997 | Keith et al. | 175/431 |
| 5,667,028 | 9/1997 | Truax et al. | 175/428 |
| 5,722,499 | 3/1998 | Nguyen et al. | 175/431 |
| 5,746,280 | 5/1998 | Scott et al. | 175/374 |
| 5,752,573 | 5/1998 | Scott et al. | 175/374 |
| 5,766,394 | 6/1998 | Anderson et al. | 156/89.11 |
| 6,068,071 * | 5/2000 | Jurewicz | 175/432 |
| 6,102,140 * | 1/1995 | Boyce et al. | 175/374 |

FOREIGN PATENT DOCUMENTS

| | | |
|---|---|---|
| 0 029 535 A1 | 6/1981 | (EP) . |
| 1014433 | 12/1965 | (GB) . |
| WO 97/48876 | 12/1997 | (WO) . |

* cited by examiner

*Primary Examiner*—Thomas B. Will
*Assistant Examiner*—Meredith Petravick
(74) *Attorney, Agent, or Firm*—Rosenthal & Osha L.L.P.

(57) ABSTRACT

Superhard material enhanced inserts include a body portion adapted for attachment to the earth-boring bit and a top portion for contacting an earthen formation to be drilled. The top portion includes a substrate and a layer of superhard material over a portion of the substrate other than in the outer lateral face. For example, superhard material is provided on the leading edge, the leading face, the crest, the trailing edge, and the trailing face, but not on a portion of the outer lateral face of the top portion. Suitable superhard materials include boron nitride and diamond.

48 Claims, 11 Drawing Sheets

SUPERHARD MATERIAL ENHANCED INSERTS FOR EARTH-BORING BITS

Field of the Invention

This invention relates to earth-boring bits with superhard material enhanced inserts for drilling blast holes, oil and gas wells, and the like.

BACKGROUND OF THE INVENTION

Earth-boring bits, such as roller cone rock bits, are employed for drilling oil wells through rock formations, or for drilling blast holes for blasting in mines and construction projects. Earth-boring bits are also referred to as drill bits. During operation, a drill bit is connected to a drill string at one end and typically has a plurality of wear-resistant inserts imbedded in roller cones attached to a bit body at the other end. An insert usually has a substantially cylindrical body portion which is adapted to fit in an insert hole and a top portion which protrudes from the insert hole for contacting an earthen formation.

When a roller cone rock bit is used to drill a borehole, it is important that the diameter or gage of the borehole be maintained at a desired value. The first outermost row of inserts of each roller cone of a rock bit that cuts to a full gage borehole and the corner of borehole is referred to as the gage row. This row of inserts generally is subjected to the greatest breakage and wear as it reams the borehole wall and cuts the corner of the borehole. As the gage row inserts break and/or wear, the diameter of the borehole being drilled may decrease below the original gage diameter of the rock bit. When the bit is worn out and removed, a portion of the hole usually is under-gage. When the next bit is run in the hole, it is therefore necessary to ream that portion of the hole to bring it to the full gage. This not only takes substantial time but also commences wear on the gage row inserts of the newly inserted bit.

In addition to gage row inserts, a conventional bit typically includes a number of inner row inserts located on a roller cone and disposed radially inward from the gage row. These inner row inserts are sized and configured for cutting the bottom of the borehole. Sometimes, a conventional bit also may include a plurality of secondary gage inserts located between the gage row inserts. These inserts, referred to as "nestled gage inserts," typically cut the full gage of the borehole and also assist the gage inserts in cutting the borehole corner. Because a borehole primarily is cut by the collective action of the gage row inserts, nestled gage inserts (if therein), and inner row inserts, they are considered as the main cutting inserts of a rock bit.

In contrast, a conventional rock bit may include a row of heel inserts located on the frustoconical surface of a roller cone. The heel row inserts generally scrape and ream the side wall of a borehole as the roller cone rotates about its rotational axis. As such, the heel row inserts are not considered as the main cutting inserts; rather, they are deemed as auxiliary cutting inserts.

Due to the different functions performed by the main cutting inserts and auxiliary cutting inserts, the two types of inserts experience different loading conditions during use. Thus, their impact of the performance and lifetime of a rock bit is different. Generally, the main cutting inserts have far more significant influence than the auxiliary cutting inserts, and the auxiliary cutting inserts experience less wear and abrasion and breakage than the main cutting inserts.

The performance of a rock bit is measured, in part, by total drilling footage and rate of penetration. As the main cutting inserts on a rock bit wear, the rate of penetration decreases. When the main cutting inserts have been substantially worn out, it is no longer economical to continue drilling with such a rock bit. At this time, the rock bit must be replaced by a new one. The amount of time required to make a round trip for replacing a bit is essentially lost from drilling operations. This time can become a significant portion of the total time for completing a well. Therefore, constant efforts have been made to manufacture main cutting inserts that would increase the rate of penetration and total drilling footage of a rock bit. In particular, there have been numerous attempts to reduce wear and breakage and increase the cutting efficiency of the main cutting inserts.

Two kinds of wear-resistant inserts have been developed for use as main cutting inserts on a rock bit. They include tungsten carbide inserts and polycrystalline diamond enhanced inserts. Tungsten carbide inserts are formed of cemented tungsten carbide. A typical composition for cemented tungsten carbide is tungsten carbide particles dispersed in a cobalt binder matrix. A polycrystalline diamond enhanced insert, an improvement over the tungsten carbide insert, typically includes a cemented tungsten carbide body as a substrate and a layer of polycrystalline diamond ("PCD") directly bonded to the tungsten carbide substrate on the top portion of the insert. Some prior art PCD enhanced inserts utilize polycrystalline diamond substantially over the entire surface of the top portion of a tungsten carbide insert as an improvement over the prior art tungsten carbide inserts. Other prior art PCD enhanced inserts utilize polycrystalline diamond at the central region of the section of the insert that substantially contacts a borehole corner or bottom.

Although the polycrystalline diamond layer is extremely hard and wear resistant, a polycrystalline diamond enhanced insert may still fail during normal operation. The typical failure mode is cracking of the polycrystalline diamond layer due to high contact stress, lack of toughness, and insufficient fatigue strength. A crack in the polycrystalline diamond layer during drilling may cause the polycrystalline diamond layer to spall or delaminate. Furthermore, a crack in the polycrystalline diamond layer may propagate through the cemented tungsten carbide body of the insert and cause complete failure of the insert.

For the foregoing reasons, there exists a need for superhard material enhanced main cutting inserts with increased cutting efficiency to drill through rock formations without substantial breakage or delamination of the polycrystalline diamond layer.

SUMMARY OF THE INVENTION

The invention meets the aforementioned need by one or more of the following aspects. In one aspect, the invention relates to a rock bit for drilling a borehole. The rock bit comprises (a) a bit body; (b) a roller cone rotatably mounted on the bit body; and (c) a plurality of main cutting inserts located on the roller cone to cut at least a portion of the corner or bottom of the borehole. At least one main cutting insert comprises a body portion secured in the roller cone and a top portion extending from the roller cone. The top portion includes a substrate and has an outer lateral face with a central region. A layer of superhard material is provided over at least a portion of the substrate, but not in the central region of the outer lateral face. The outer lateral face may further include a peripheral region, and the layer of superhard material may extend to at least a portion of the peripheral region of the outer lateral face. In addition, the top portion may further include a secondary surface, and the layer of superhard material may be provided over at least a portion of the substrate in the secondary surface. As such, a cutting edge of superhard material is formed in the outer lateral face when a portion of the substrate in the central region of the outer lateral face is worn away. Preferably, the layer of superhard material in the secondary surface and the peripheral region of the outer lateral face substantially or completely surrounds the central region of the outer lateral face. The outer lateral face may be convex, concave, planar, or non-planar. Preferably, the central region of the outer lateral face includes the centroid of the outer lateral face. The at least one main cutting insert may be a gage insert, an off-gage insert, a nestled gage insert, and an inner row insert.

In another aspect, the invention relates to a rock bit. The rock bit comprises (a) a bit body; (b) a roller cone rotatably mounted on the bit body; (c) a plurality of main cutting inserts located on the roller cone to cut at least a portion of the corner or bottom of the borehole. At least one main cutting insert comprises a body portion secured in the roller cone and a top portion extending from the roller cone. The top portion includes a substrate and has an outer lateral face. At least a portion of the outer lateral face is free of superhard material, and the portion free of superhard material is substantially surrounded by superhard material. In some embodiments, the outer lateral face has a central region and a peripheral region, and the central region is free of superhard material and at least a portion of the peripheral region is provided with superhard material. In other embodiments, the outer lateral face is partially coated with a layer of superhard material. Furthermore, the central region may be substantially formed of tungsten carbide.

In still another aspect, the invention relates to a rock bit. The rock bit comprises (a) a bit body; (b) a roller cone rotatably mounted on the bit body; (c) a plurality of main cutting inserts located on the roller cone to cut at least a portion of the corner or bottom of the borehole. At least one main cutting insert comprises a body portion secured in the roller cone and a top portion extending from the roller cone. The top portion includes a substrate and has an outer lateral face. At least a portion of the outer lateral face is free of superhard material, and the portion free of superhard material is substantially surrounded by superhard material. The portion free of superhard material is formed of a material with a hardness that is at least 500 Vickers lower than the superhard material.

In yet another aspect, the invention relates to a rock bit. The rock bit comprises (a) a bit body having a leg; (b) a roller cone rotatably mounted on the leg; and (c) a plurality of main cutting inserts located on the gage row and the inner row of the roller cone. Each main cutting insert comprises a substantially cylindrical body portion secured in the roller cone and a top portion integral with the body portion and extending from the roller cone. The top portion includes a cemented tungsten carbide substrate, and it has an outer lateral face and a secondary surface. A continuous layer of polycrystalline diamond is provided over the entire substrate in the secondary surface, but not over the substrate forming the outer lateral face. As such, the substrate forming the outer lateral face is substantially free of superhard material.

In yet still another aspect, the invention relates to a method of manufacturing a rock bit. The method comprises (a) providing an insert having a body portion and a top portion; the top portion includes a substrate and has an outer lateral face; the outer lateral face has a central region; (b) forming a layer of superhard material over the substrate of the top portion, but not in the central region of the outer lateral face; (c) securing the body portion of the insert having the layer of superhard material in a roller cone at a location to cut the corner or bottom of a borehole; and (d) rotatably mounting the roller cone on a bit body. In some embodiments, the outer lateral face further includes a peripheral region, and the layer of superhard material extends to the peripheral region of the outer lateral face. The top portion may further include a secondary surface, and the layer of superhard material extends to the secondary surface. In other embodiments, a recess is formed in the insert before forming the layer of superhard material. Preferably, the layer of superhard material is formed under a high-pressure and high-temperature sintering condition. A high-shear compaction tape or a composite construction material may be used to form the layer of superhard material.

In one aspect, the invention relates to a method of manufacturing a rock bit. The method comprises (a) providing an insert having a body portion and a top portion; the top portion includes a substrate and has an outer lateral face; at least a portion of the outer lateral face is free of superhard material; the portion free of superhard material is substantially surrounded by superhard material; (b) securing the body portion of the insert having the superhard material in a roller cone at a location to cut the corner or bottom of a borehole; and (c) rotatably mounting the roller cone on a bit body.

DETAILED DESCRIPTION OF THE PREFERRED EMBODIMENTS

Embodiments of the invention provide superhard material enhanced main cutting inserts (hereinafter "enhanced inserts") for an earth-boring bit. The enhanced insert includes a body portion adapted for attachment to the earth-boring bit and a top portion for contacting an earthen formation to be drilled. The top portion includes a substrate and a layer of superhard material over a portion of the substrate, but not in the central region of the outer lateral face.

Figure 3:
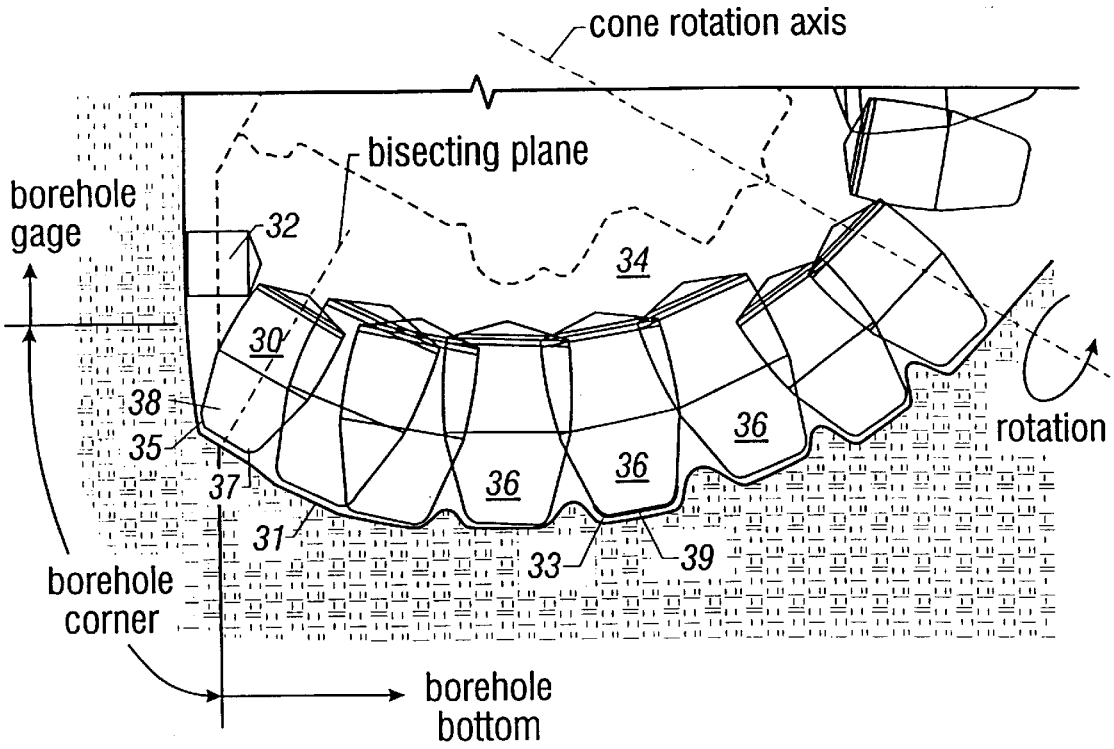
FIG. 3 is an overlay of all three roller cones of a rock bit and their respective inserts rotated into the same plane in a borehole.

The term "main cutting insert" refers to the insert that cuts at least a portion of a borehole corner or a borehole bottom (see FIG. 3). It should be understood that "cutting" or "cut" used herein includes any mechanical action that chips, crushes, gouges, shears, breaks, or separates an earthen formation. Generally, main cutting inserts includes gage row inserts, off-gage inserts (which are located slightly off the gage row of a roller cone), nestled gage row inserts, inner row inserts, and so on. But main cutting inserts do not include heel row inserts, which ream and scrape the sidewall of a borehole, but do not cut a borehole corner or bottom.

The body portion refers to the part of an insert that is secured in a roller cone, and the top portion generally refers to the part of the insert that protrudes from the surface of the roller cone after being secured therein. The top portion has an outer surface that includes an outer lateral face and a secondary surface. The outer lateral face of an insert (illustrated in FIG. 3) herein refers to the area or surface that substantially contacts or parallels a borehole bottom or at least a portion of a borehole corner. The outer lateral surface also is referred to the "wear face" of an insert. Generally, the outer lateral face of a gage row insert or a nestled gage row insert is the gage contact face, whereas the outer lateral face of an inner row insert is the crest area. Failure of an insert generally occurs at or at least initiates at the outer lateral face as this area typically is in contact with the formation more than the other portions of the insert and the loading usually is highest on an insert at the outer lateral face. The secondary surface of the top portion of an insert refers to the remainder of the outer surface, and it may or may not contact an earthen formation during use.

Embodiments of the invention are based, in part, on the realization that different areas of an insert encounter different loading conditions and consequently, different stresses, i.e., tensile, compressive, fatigue, etc. A homogeneous polycrystalline diamond layer over the substrate of a top portion an insert (as has been done in the prior art) is not optimized for handling such various loading and wear conditions. It has been determined that the polycrystalline diamond surfaces on an insert of a roller cone rock bit typically do not wear. Because of that, fatigue loading on the polycrystalline diamond may lead to fatigue failure of the polycrystalline diamond coating, typically in the form of diamond chipping, spalling and breakage. The diamond chipping and breakage also may propagate into the underlying tungsten carbide substrate, causing catastrophic insert failure. Generally, the chipping and the breakage of the polycrystalline diamond layer often commences at the outer lateral face of an insert which is illustrated in the following.

Figure 1A:
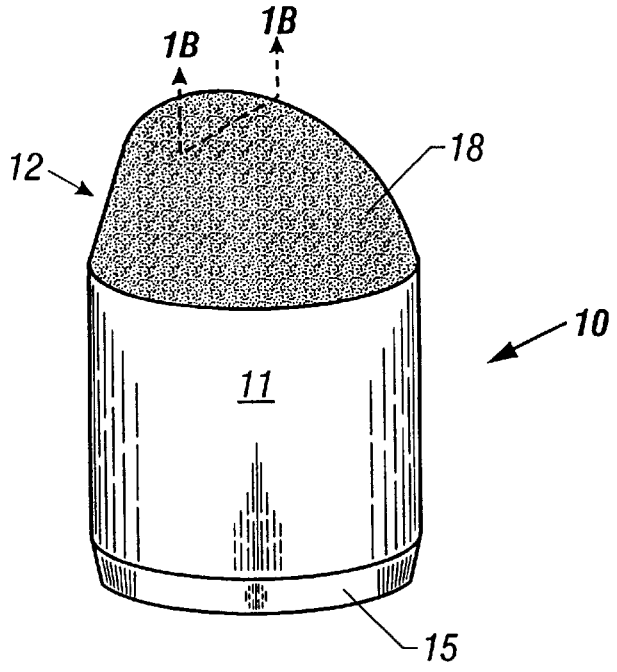
FIG. 1A (PRIOR ART)
FIG. 1A is a perspective view of a prior art PCD insert with a chisel shaped top portion.
Figure 1B:
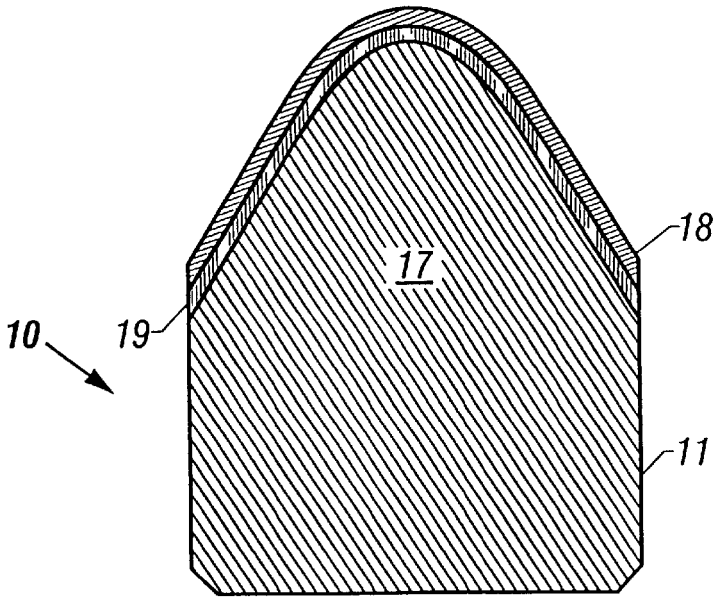
FIG. 1B (PRIOR ART)
FIG. 1B is a cross-sectional view of the prior art PCD insert of FIG. 1A taken along the line 1B—1B.

FIG. 1A shows a perspective view of a typical prior art PCD insert, and FIG. 1B is a cross-sectional view of the prior art PCD insert. An insert 10 includes a cylindrical body portion 11 and a top portion 12. A homogeneous layer of polycrystalline diamond 18 typically is overlaid on all of the faces of the top portion 12. The polycrystalline diamond layer 18 is bonded to a tungsten carbide insert 17 as a substrate. Optionally, there may be one or more transition layers 19 between the polycrystalline diamond layer 18 and the substrate 17 that reduce the residual stress that develops due to the thermal mismatch between polycrystalline diamond and tungsten carbide materials.

Because the polycrystalline diamond layer 18 of the prior art insert 10 has a homogeneous composition throughout the surface of the top portion 12, the wear resistance of the polycrystalline diamond layer throughout the entire surface of the top portion 12 is uniform. However, during use, different areas of the top portion 12 experience dissimilar loading, wear and impact forces. As such, different areas of an insert have different requirements for strength, wear resistance, toughness and fatigue strength, which are not met by the prior art insert 10.

When the insert 10 is used as a main cutting insert in a roller cone bit, no significant wear occurs in the polycrystalline diamond layer. Instead, chipping and breakage of the polycrystalline diamond layer may occur. This is because some areas of the insert, e.g., the outer lateral face, experience a substantially higher impact and/or loading force than other areas of the insert. The impact force initiates cracks on the surface of the polycrystalline diamond layer where the insert is in contact with an earthen formation. Localized chipping of a polycrystalline diamond layer then occurs when the cracked length reaches a critical level. After the formation of localized chipping of a polycrystalline diamond layer, several events may occur. They include (1) crack propagation into the tungsten carbide substrate; (2) spalling and/or peeling of the polycrystalline diamond layer; and (3) creation of a wear flat on the tungsten carbide substrate. The formation of the wear flat (if not already there), although less frequent, is due to loss of the polycrystalline diamond layer surrounding the wear flat and the wear of exposed carbide substrate. As the polycrystalline diamond layer chips, spalls and peels off, substantial loss of the wear resistant material on the insert may occur, which typically leads to eventual destruction of the insert and loss of cutting efficiency. These stages of events leading to failure of an insert is typical to inner row inserts as well as gage and heel row inserts.

Embodiments of the invention reduce or minimize the formation of chips and cracks in a polycrystalline diamond layer by eliminating the primary area responsible for the formation of such chips and cracks in the polycrystalline diamond layer. This is achieved by not providing a polycrystalline diamond layer in that area. The primary area responsible for the formation of chips and cracks of a polycrystalline diamond layer generally is the central region of the outer lateral face. By not providing a polycrystalline diamond layer in the central region of the outer lateral face, the effects of substantial impact forces and fatigue in this area upon the polycrystalline diamond layer are substantially eliminated. As such, less chipping and breakage of polycrystalline diamond layer is likely to occur. On the other hand, a polycrystalline diamond layer is provided in the areas of an insert that require wear-resistance and experience less impact forces and fatigue failures. Because a portion of the outer lateral face is not provided with polycrystalline diamond, this portion may wear and consequently cause the diamond surrounding that portion to wear. The wearing away of the surrounding diamond is preferred as it is a controlled form of wear that can allow the polycrystalline diamond in the outer lateral face of an insert in contact with the formation to wear away before it can develop fatigue cracks in the PCD. If fatigue cracks do develop, the preferential wear may prevent the micro-cracks from propagating into polycrystalline diamond failure and overall catastrophic insert failure. Such inserts should have a longer lifetime because a polycrystalline diamond layer is provided only in the area where it is needed, and it is not provided in the area where it might shorten the lifetime of the overall polycrystalline diamond layer.

Figure 2A:
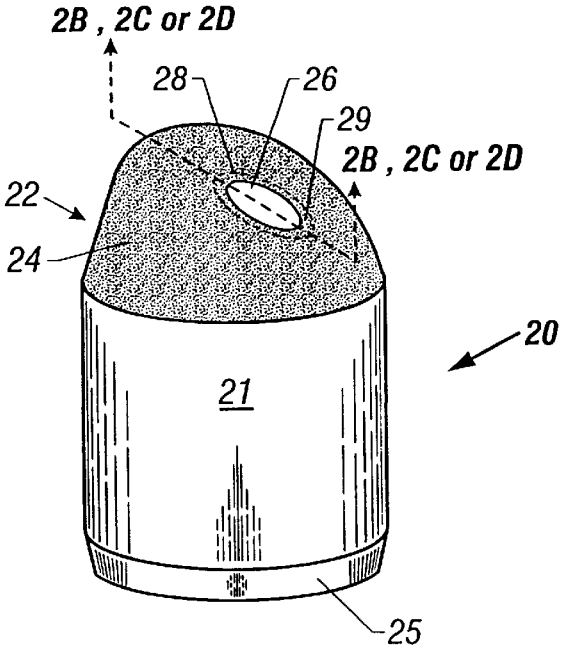
FIG. 2A is a perspective view of an enhanced insert according to one embodiment of the invention.
Figure 2B:
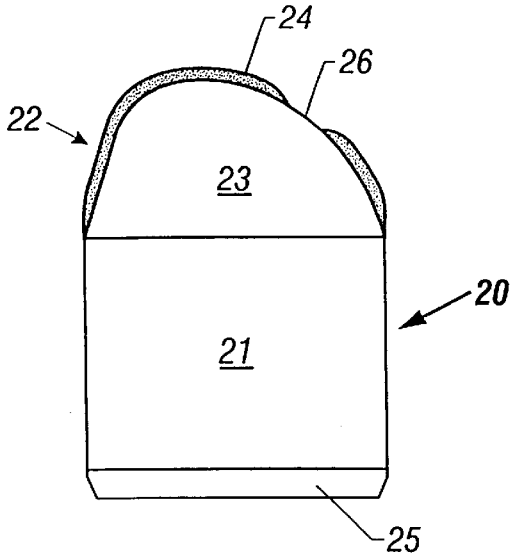
FIG. 2B is a sectional top view of the enhanced insert of FIG. 2A taken along the line 2B—2B.
Figure 2C:
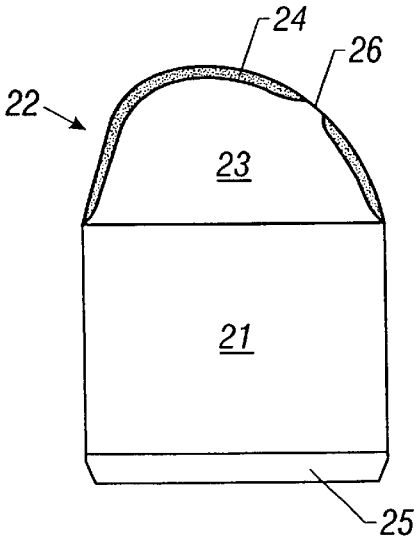
FIG. 2C is a sectional top view of an alternative embodiment of the enhanced insert of FIG. 2A taken along the line 2C—2C.

To exemplify the above concept, FIG. 2A shows a gage row insert according to one embodiment of the invention. Referring to FIG. 2A, an enhanced insert 20 includes a body portion 21 and a top portion 22. The top portion 22 includes an outer lateral face 28 and a secondary surface 24. The outer lateral face further includes a central region 26 and a peripheral region 29. A polycrystalline diamond layer is provided over the substrate in the secondary surface 24 and the peripheral region 29, but not over the substrate in the central region 26 of the outer lateral face. The polycrystalline diamond layer may either protrude from the substrate or be recessed in the substrate. It also may be flush with the substrate surface. FIGS. 2B and 2C are side sectional views of the insert 20 and show two alternative ways to place a layer of polycrystalline diamond on the substrate.

Figure 2D:
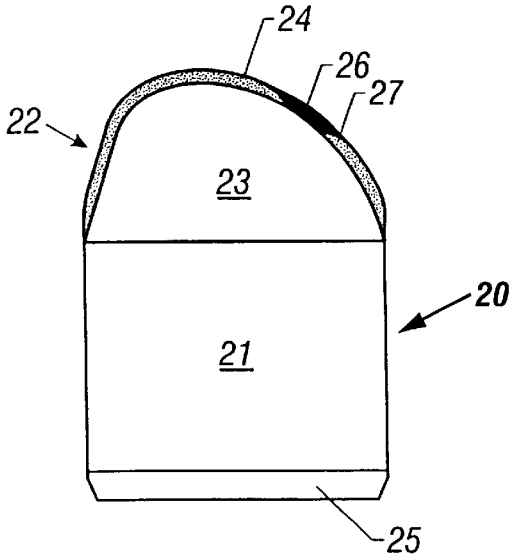
FIG. 2D is a sectional top view of an alternative embodiment of the enhanced insert of FIG. 2A taken along the line 2D—2D.

FIG. 2D is a sectional side view of another embodiment of the insert 20 in which the superhard material composition of the central region 27 is different than the superhard material in the secondary surface 24 and also is different than the substrate material. If the hardness of the material in the central region 27 is about 500 Vickers or less than the superhard material on the secondary surface 24 and/or the peripheral region 29, the outer lateral face is likely to promote wear to help alleviate chipping and breakage of the insert. Suitable materials for the central region 27 include, but are not be limited to, various grades of cemented tungsten carbide and composites of tungsten carbide and superhard materials that have a lower wear resistance. Some mixtures of carbide and polycrystalline diamond (or polycrystalline cubic boron nitride) are not superhard material because their overall wear resistance (or hardness) is lower. On the other hand, other mixtures of carbide and polycrystalline diamond (or polycrystalline cubic boron nitride) are considered superhard material, depending on their wear resistance and hardness. It is noted that wear resistance generally is proportional to hardness, although they need not be. Superhard material typically is known to have a hardness of about 2,200 Vickers or higher, whereas the hard material suitable for the central region may have a hardness of 2,200 Vickers or lower.

The embodiment illustrated in FIG. 2D may be beneficial in that the wear rate on the top portion of the insert may be controlled and optimized. In this embodiment, the wear resistance of the superhard material is different than that of the material in the central region 27, which also is different than that of the substrate 23. By adjusting the wear resistance of the three materials, the wear rate may be optimized for improved performance.

FIG. 3 illustrates the concept of the "outer lateral face" of a main cutting insert. It is an overlay of all three roller cones of a rock bit and their respective inserts rotated into the same plane and shows a cross-sectional view of a roller cone and the side wall of a borehole. Referring to FIG. 3, the roller cones collectively indicated as 34 includes a heel row insert 32, a gage row insert 30, and a plurality of inner row inserts 36.

As the roller cone rotates around the cone rotation axis, the gage row insert 30 comes in contact with the borehole corner, and the inner row inserts 36 contacts the borehole bottom. The formation at the borehole corner generally is cut by a combination of a shearing, chipping and crushing action of the gage row insert. The formation at the borehole bottom generally is cut by a gouging and crushing action of the inner row inserts 36. On the other hand, the heel row insert 32 contacts the borehole gage (i.e., the side wall of the borehole) after the borehole corner and side wall is cut and helps maintain a full gage borehole by scraping and reaming the side wall.

When the gage row insert 30 is in contact with the borehole corner, there exists a point or area of contact 35 between the insert 30 and the borehole corner. The point or area of contact 35 herein is referred to as the "outer lateral face" for a gage or nestled gage row insert. This outer lateral face sometimes is referred to in the art as the "gage contact area." Generally, the insert 30 generally is divided into two portions: an outer portion 38 and an inner portion 37. The outer portion 38 is the portion of the insert that is closer to or in contact with the borehole corner. On the other hand, the inner portion 31 is the portion of the insert opposite the outer portion 38 divided by a bisecting plane as indicated. The outer lateral face typically lies in the outer portion 38 of the insert 30.

Inner row inserts 36 generally contact the formation at the crest area (indicated by the boldface) 39 and the outer corner 33. Therefore, these areas are referred to as the outer lateral face of an inner row insert.

It should be recognized that an outer lateral face may be planar, non-planar, curved, multifaceted, convex, or concave. This surface may take any symmetrical and non-symmetrical shapes, including but not limited to, circular, oval, elliptical, triangular, rectangular, and irregular shapes. The outer lateral face includes a central region and a peripheral region. The central region is the region that substantially contacts the corner or bottom of a borehole. As such, the central region generally is situated at or near the center or middle point of the outer lateral face and generally should include the centroid of the outer lateral face. The shape of the central region may be substantially similar to the shape of the outer lateral face, except that it has a smaller area. The peripheral region refers to the outermost region in the transition between the outer later face and the remaining faces of the top portion. In some embodiments, superhard material is provided over the substrate in the peripheral region; in other embodiments, no superhard material is provided in the peripheral region. The size of the central region in relationship to the outer lateral face varies according to the insert and outer lateral face geometry, the application of the inserts, the wear resistance of the superhard material as well as other factors.

The enhanced inserts according to embodiments of the invention are different from prior art inserts. For example, the substrate of the top portion of the enhanced inserts is partially exposed, as opposed to the fully encapsulated diamond enhanced insert of FIG. 1. Furthermore, the enhanced inserts also differ from a prior art diamond enhanced insert which has a partially exposed surface. The difference is illustrated as follows.

Figure 4A:
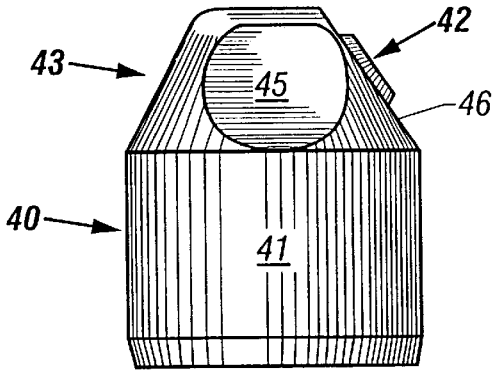
FIG. 4A (PRIOR ART)
FIG. 4A is a perspective view of a prior art insert having a polycrystalline diamond compact placed on the outer lateral face of the insert.
Figure 4B:
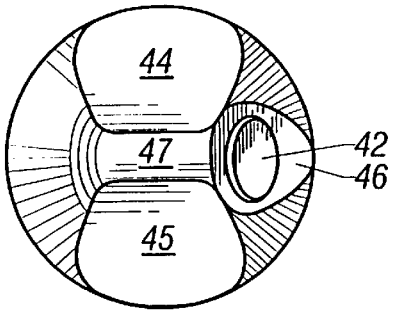
FIG. 4B (PRIOR ART)
FIG. 4B is a top view of the insert of FIG. 4A.

FIG. 4A shows a perspective view of a prior art PCD enhanced insert, and FIG. 4B is a top view of the prior art PCD insert. The insert 40 includes a cylindrical body portion 41 and a top portion 43. A piece of polycrystalline diamond (i.e., a polycrystalline diamond compact) 42 is placed in the outer lateral face 46 of the top portion 43. The top portion 43 also includes a leading face 44, a trailing face 45, and a crest 47 which are free of polycrystalline diamond.

Figure 4C:
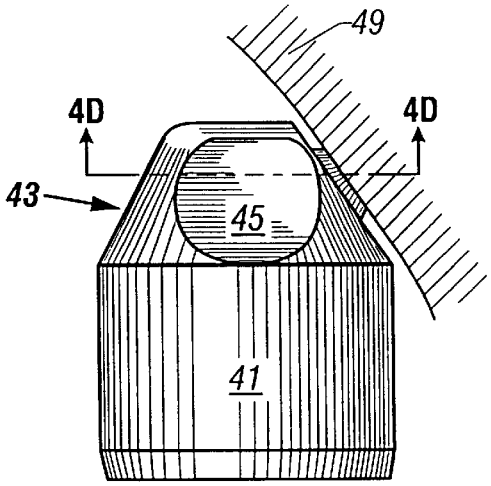
FIG. 4C (PRIOR ART)
FIG. 4C is a schematic of the insert of FIG. 4A in contact with a rock formation.
Figure 4D:
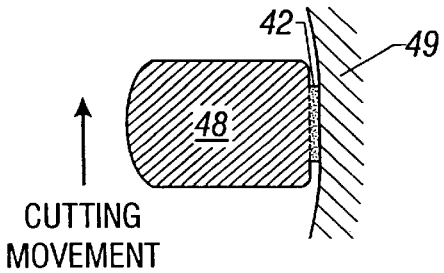
FIG. 4D (PRIOR ART)
FIG. 4D is a top sectional view of the insert of FIG. 4C taken along the line 4D—4D.

As illustrated in FIG. 4C, when the insert 40 is used as a main cutting insert, e.g., a gage insert, on a roller cone bit, the outer lateral face with a polycrystalline diamond compact 42 substantially contacts the corner of a borehole and cuts the corner by crushing, chipping, and shearing the formation 49. FIG. 4D is a top sectional view of the insert 40 in contact with the formation 49. As the insert 40 cuts the formation 49 in the direction of cutting movement, both the polycrystalline diamond compact 42 and the tungsten carbide substrate 48 beneath it contact the formation. Because tungsten carbide is significantly less wear resistant than polycrystalline diamond, it tends to wear away faster. This leads to undesired wear of the tungsten carbide substrate 48 beneath the polycrystalline diamond compact 42. Because the diamond compact 42 is under large compressive stresses, it may crack and break off after the underlying supporting material is worn away. Also, because of the large surface area of polycrystalline diamond compact 42, the polycrystalline diamond may not wear appreciably, thus making it susceptible to fatigue failure.

Figure 5A:
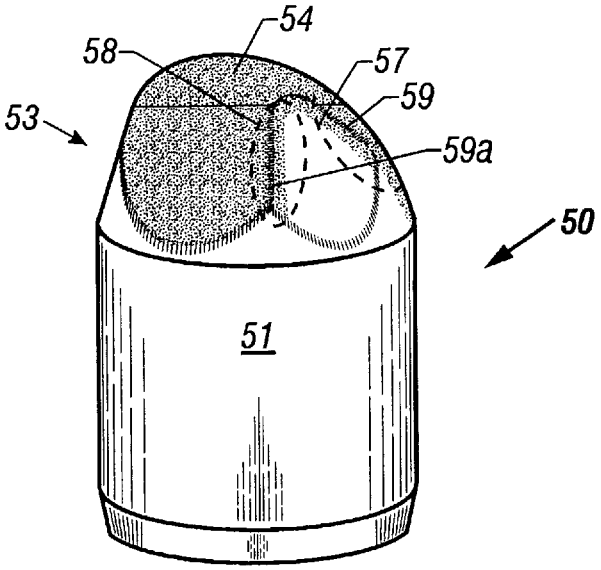
FIG. 5A is a perspective view of an enhanced insert according to one embodiment of the invention.
Figure 5B:
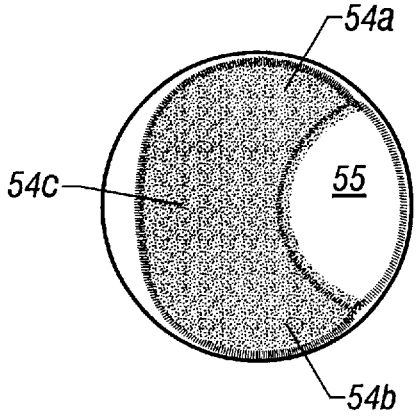
FIG. 5B is a top view of the insert of FIG. 5A.
Figure 5C:
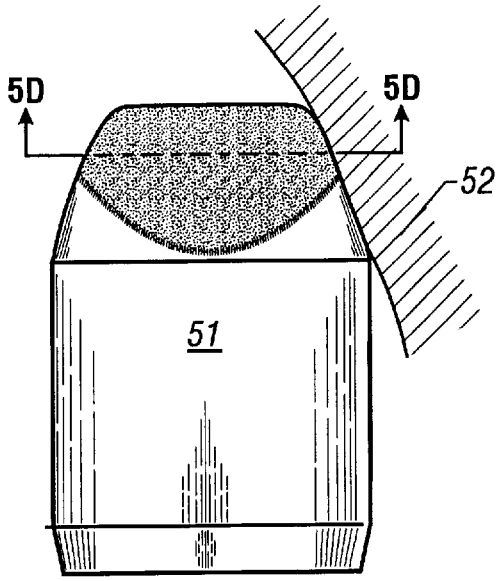
FIG. 5C is a schematic of the insert of FIG. 5A in contact with a rock formation.
Figure 5D:
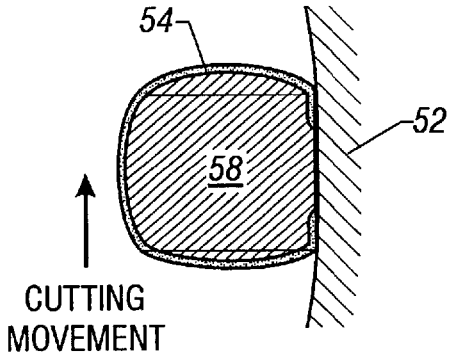
FIG. 5D is a top sectional view of the insert of FIG. 5C taken along the line 5D—5D.

In contrast, the polycrystalline diamond on the enhanced inserts according to embodiments of the invention is provided in a manner opposite to the prior art PCD enhanced insert 40. FIGS. 5A–5D show an enhanced insert having a chisel-shaped top portion. Referring to FIG. 5A and 5B, an enhanced insert 50 includes a body portion 51 and a top portion 53. The top portion 53 includes an outer lateral face 55 which is free of any superhard material and a layer of polycrystalline diamond 54 in the leading edge 59, the leading face 54*a*, the trailing edge 59*a*, the trailing face 54*b*, and the crest 54*c*. When this insert is used to cut the corner of a borehole as illustrated in FIG. 5C, the polycrystalline diamond contacts the formation 52 in the leading transition 57 and the trailing transition 58. However, the central region of the outer lateral face 55 is free of polycrystalline diamond so that crack initiation sites in this region are eliminated and preferential wear is promoted. FIG. 5D illustrates a cross-section of the insert in contact with the formation 52. This configuration of polycrystalline diamond on the insert should lengthen the life of the polycrystalline diamond layer 24, thereby increasing the lifetime of the insert. While the insert 50 is shown to have superhard material in the peripheral region of the outer lateral face 55, it also is acceptable not to provide superhard material in the peripheral region.

Figure 6:
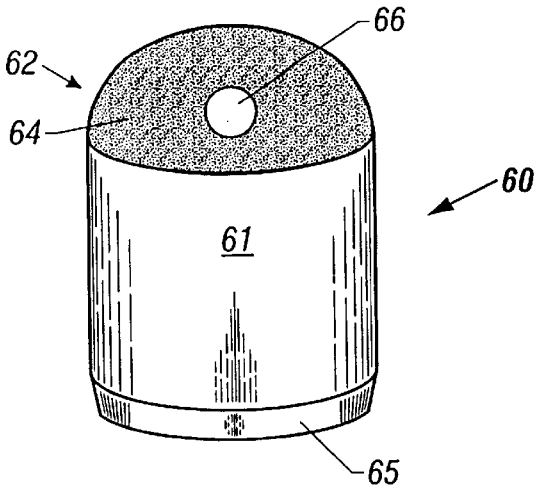
FIG. 6 is a perspective view of one embodiment of an enhanced insert with a semi-round top portion according to the invention.

FIG. 6 shows another embodiment of the invention. Referring to FIG. 6, an insert 60 includes a body portion 61 and a top portion 62. The top portion 62 is semi-round. Although a flat outer lateral face is not preformed, its location 66 is identified. A layer of polycrystalline diamond 64 is provided around the intended outer lateral face 66.

Figure 7A:
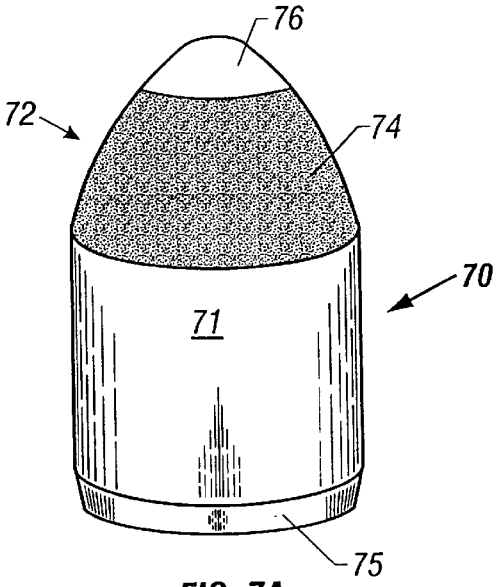
FIG. 7A is a perspective view of one embodiment of an enhanced insert with a conical top portion.
Figure 7B:
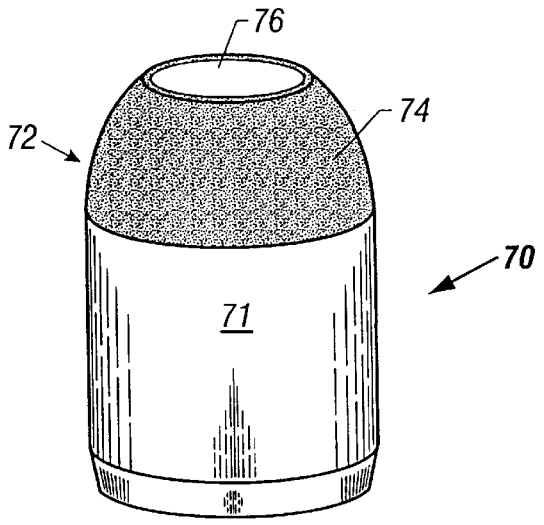
FIG. 7B is a perspective view of an alternative embodiment of an enhanced insert with a conical top portion.

FIG. 7A shows still another embodiment of the invention. Referring to FIG. 7A, an inner row insert 70 includes a body portion 71 and a top portion 72. The top portion 72 is conical. As an inner row insert, the outer lateral face is in the crest area of the conical top portion. As such, the tip 76 is not provided with polycrystalline diamond, whereas a layer of polycrystalline diamond 74 is provided in the remaining region of the top portion. FIG. 7B illustrate another embodiment of an inner row insert which has a conical top portion with a flat top.

In embodiments of the invention, the body portion of an insert is substantially cylindrical, although any other shapes also are feasible. It is formed of a hard material, such as hard metals, hard ceramic materials, cermets. Preferably, carbides, nitrides and silicides are used. More preferably, cemented tungsten carbide is used. In preferred embodiments, the body portion is formed of the same material as the substrate forming the top portion. However, it is entirely feasible to manufacture inserts with the body portion and the substrate being formed of different materials.

The top portion may take various shapes, e.g., ballistic, conical, semi-round, symmetrical, asymmetrical, chisel-shaped, inclined chisel-shaped, etc. The substrate of the top portion may be formed of carbide, nitride, silicide and other suitable materials. Preferably, cemented tungsten carbide in a cobalt matrix is used as the material for the substrate.

One example of inserts with an asymmetrical top portion is the shaped insert which is disclosed in U.S. Pat. No. 6,059,054, entitled "Non-Symmetrical Stress-Resistant Rotary Drill Bit Cutter Element," filed Jun. 3, 1997. The disclosure of this application is incorporated by reference herein in its entirety. A shaped insert generally has its outer lateral face canted or relieved away from the borehole wall and in the direction of the trailing face so that the trailing transition experiences less friction, thereby increasing the insert lifetime.

It should be recognized that inserts with various shapes and surface finishes may be employed in embodiments of the invention. For example, inserts with a contoured surface are especially suitable. Such inserts are disclosed in U.S. Pat. No. 5,322,138. In addition, inclined chisel inserts may be employed as well. Such inclined chisel inserts are disclosed in U.S. Pat. No. 5,172,777.

Suitable superhard material includes diamond, boron nitride, and other materials with comparable hardness. Diamond may be either natural or synthetic. Polycrystalline diamond is one form of diamond that can be used in embodiments of the invention. The term "polycrystalline diamond" refers to the material produced by subjecting individual diamond crystals to sufficiently high pressure and high temperature that inter-crystalline bonding occurs between adjacent diamond crystals. Typically, polycrystalline diamond may include a metal selected from the group consisting of cobalt, nickel, iron, and alloys thereof. It may further include particles of carbide or carbonitride of elements selected from the group consisting of tungsten, titanium, tantalum, chromium, molybdenum, vanadium, hafnium, zirconium, and alloys thereof. Moreover, other compounds may also be included in polycrystalline diamond if desired. Although the term "polycrystalline diamond" is used to describe some embodiments, it should be understood that other superhard materials may be used in place of polycrystalline diamond. It is noted that superhard material need not be in the form of a layer, although it is preferred.

Figure 8A:
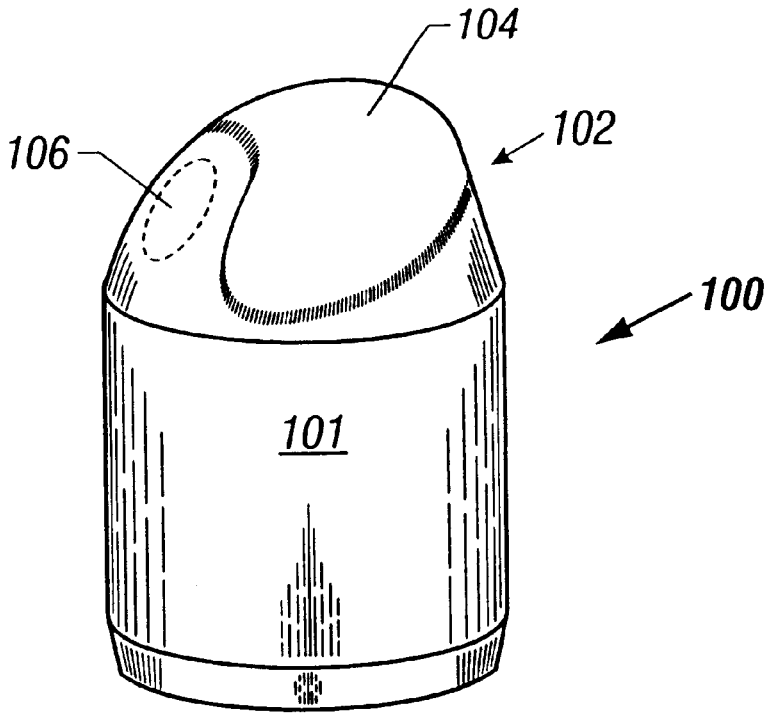
FIG. 8A is a perspective view of an insert substrate with a pocket or recess for forming a layer of superhard material in accordance with an embodiment of the invention.
Figure 8B:
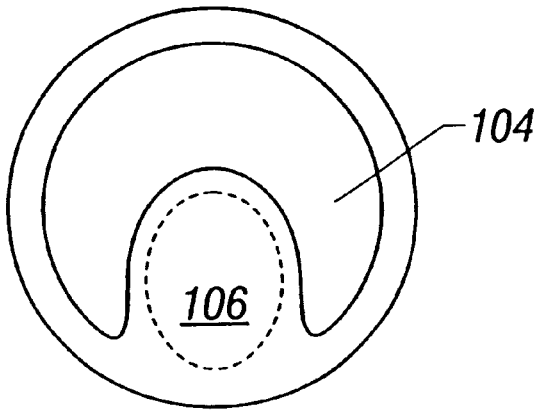
FIG. 8B is a top view of the insert substrate of FIG. 8A.

The enhanced inserts in accordance with embodiments of the invention may be manufactured by any suitable method. For example, the enhanced inserts may be manufactured by forming an appropriate pocket or recess in a substrate insert. This method is illustrated in FIGS. 8A–8B. In this method, a substrate insert, typically a tungsten carbide insert, is provided. The substrate insert 100 includes a body portion 101 and a top portion 102. A determination is made as to the location of the central region of the outer lateral face 106 on the top portion 102. Using the central region of the outer lateral face 106 as a reference, a recess or pocket is formed in a portion of the secondary surface 104. After the pocket or recess is formed with a desired geometric shape, a superhard material composition is placed in the pocket or the recess. Then, the substrate insert with the superhard material is placed in a high-pressure/high-temperature press for bonding the superhard material to the insert substrate to form the enhanced insert.

Alternatively, the enhanced inserts may be manufactured by advantageous use of high-shear compaction tapes disclosed in pending U.S. Pat. No. 5,766,394, entitled "Method for Forming a Polycrystalline Layer of Ultra Hard Material," filed on Dec. 6, 1995. The disclosure of this patent application is incorporated by reference herein in its entirety.

The high-shear compaction tape is made from a high-shear compaction material which includes particles of superhard material such as diamond or boron nitride, organic binder such as polypropylene carbonate, and possibly residual solvents such as methyl ethyl ketone. The high-shear compaction tape is prepared in a multiple roller process. Compaction occurs during this process. After the compaction process, the tape is characterized by a high "green" density and uniform distribution of particles. Such tapes are especially suitable for manufacturing a polycrystalline diamond layer on a tungsten carbide insert in a high pressure and high temperature process.

Figure 9:
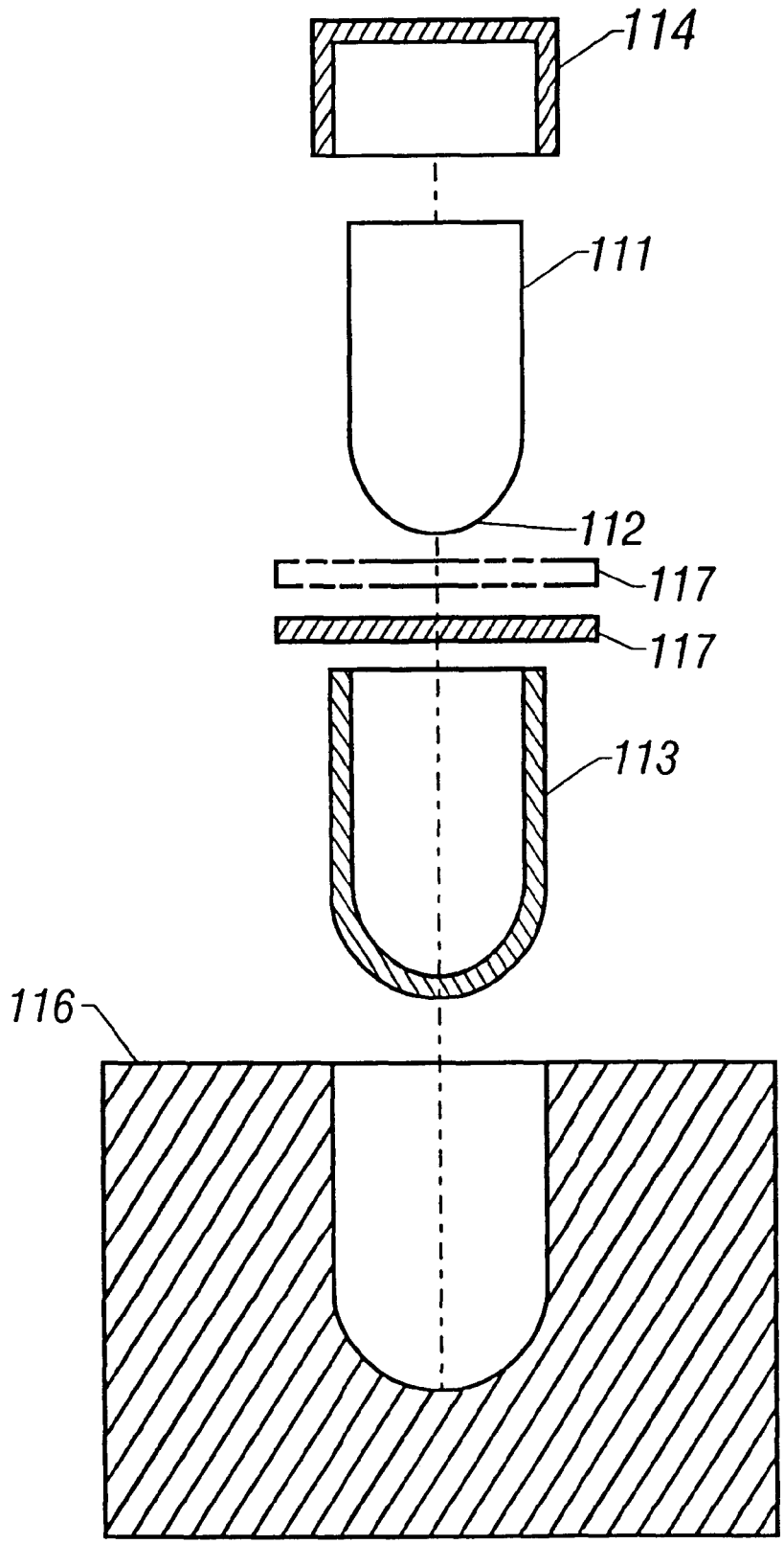
FIG. 9 is a partially sectioned exploded view of components used to fabricate an enhanced insert according to an embodiment of the invention.

FIG. 9 illustrates in exploded view components used to fabricate a polycrystalline diamond insert in accordance with embodiments of the invention. The process starts with a cemented tungsten carbide insert with a body portion 111 and a top portion 112. The polycrystalline diamond insert is made in a can 113 having an inside geometry complimentary to the geometry of the top portion 112. The can 113 and a cap 114 are typically made of niobium or other refractory metals. The can is placed in a temporary die or fixture 116 having a cavity that is complimentary to the outside geometry of the can. One or more layers of high-shear compaction sheet containing the desired superhard material compositions are placed in the hemispherical end of the can. In fact, the can serve as a mold for shaping the layer.

Figure 10:
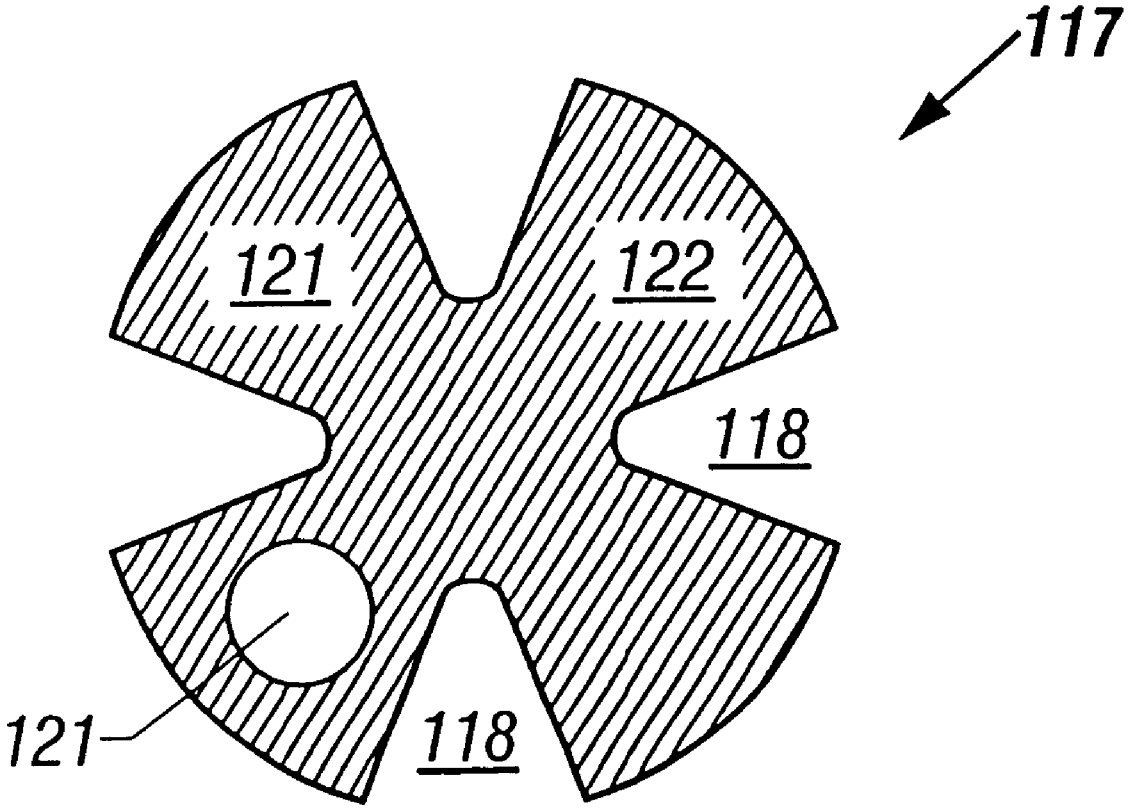
FIG. 10 is a top view of a preformed high-shear compaction tape used in FIG. 11.

Each layer comprises a preform cut from a sheet of high-shear compaction material. An exemplary preform for fitting a hemispherical top portion of an insert is illustrated in FIG. 10. The preform is a circular disk with four generally V-shaped notches 118 extending from the circumference towards the center. The notches permit the flat preform to bend into the hemispherical form of the can without extensive folding, buckling or doubling of thickness. It should be noted that the high-shear compaction sheet or tape 117 includes two areas: region 121 and region 122. The region 121 is a hole which does not include any superhard material. The region 122 includes a suitable superhard material.

If one or more transition layers are desired, additional tapes containing appropriate superhard material compositions may be used. Similar to the outer layer, a transition layer typically is formed of particles of a superhard material such as diamond or boron nitride dispersed in a metal matrix such as cobalt; but the relative weight percentage may be different from that of the outer layer.

After tapes 117 are fitted into the can 113, the insert or a punch having the same shape as the insert is then pressed into the can to smooth and form the layer of high-shear compaction tapes in the end of the can. After the material is smoothed, the insert body is placed in the can (if not already there from smoothing), and the can is removed from the fixture 116. The organic binder in the high-shear compaction tapes is then removed in a subsequent dewaxing process. Afterwards, a refractory metal cap 114 is placed around and over the open end of the can 113 to effectively seal the cemented tungsten carbide body and superhard material inside the resulting assembly. Such an assembly is subsequently placed in a high pressure and high temperature press for formation of a polycrystalline diamond layer over the tungsten carbide substrate.

Instead of using a high-shear compaction tape with a hole, a high-shear compaction tape without holes may be used in alternative embodiments. In these embodiments, a slight modification of the above-described process is necessary. A high-shear compaction tape with a suitable superhard material composition is loaded into the can 113 which has a complimentary inside geometry to that of the top portion 112. A dummy insert (not shown in FIG. 9) with an identical geometry to the insert is placed into the can 113. The dummy insert is used as ajig for cutting a hole in the high-shear compaction tape in the location where no diamond is desired. After the hole is drilled in the high-shear compaction tape, the dummy insert is removed, and a carbide insert with an identical geometry to the dummy insert is placed into the can 113. At this point, the assembly may be placed in a high-pressure/high-temperature press for sintering. If the top portion 112 has an asymmetrical geometry, there is only one way that the insert could be fitted into the can 113 that includes the high-sheer compaction tape. Therefore, this modified process has the advantage of accurately bonding the superhard material to the desired areas of an insert. After the insert is placed into the can 113, the subsequent steps are identical to the above described process.

In preferred embodiments, the hole 121 of FIG. 10 is in the shape of a circle. This is done primarily to facilitate the manufacturing process. Any geometric shapes, such as a square, a triangle, an oval, a rectangle, a semicircle, a corrugated semicircle, etc., may be employed in embodiments of the invention.

In addition to the high-shear compaction tapes, composite construction materials including a superhard material may also be used to manufacture the enhanced inserts in accordance with embodiments of the invention. Suitable composite construction materials are disclosed in U.S. Pat. No. 6,063,502, entitled "Composite Constructions with Oriented Microstructure," filed on Jul. 31, 1997, and the disclosure of this patent application is incorporated by reference herein in its entirety.

Generally, the composite construction materials include an oriented microstructure comprising arrangements of hard phase materials such as polycrystalline diamond or polycrystalline cubic boron nitride, and relatively softer binder phase materials such as metals, metal alloys, and in some instances cermet materials. FIG. 11 illustrates two embodiments of the composite construction material.

Figure 11A:
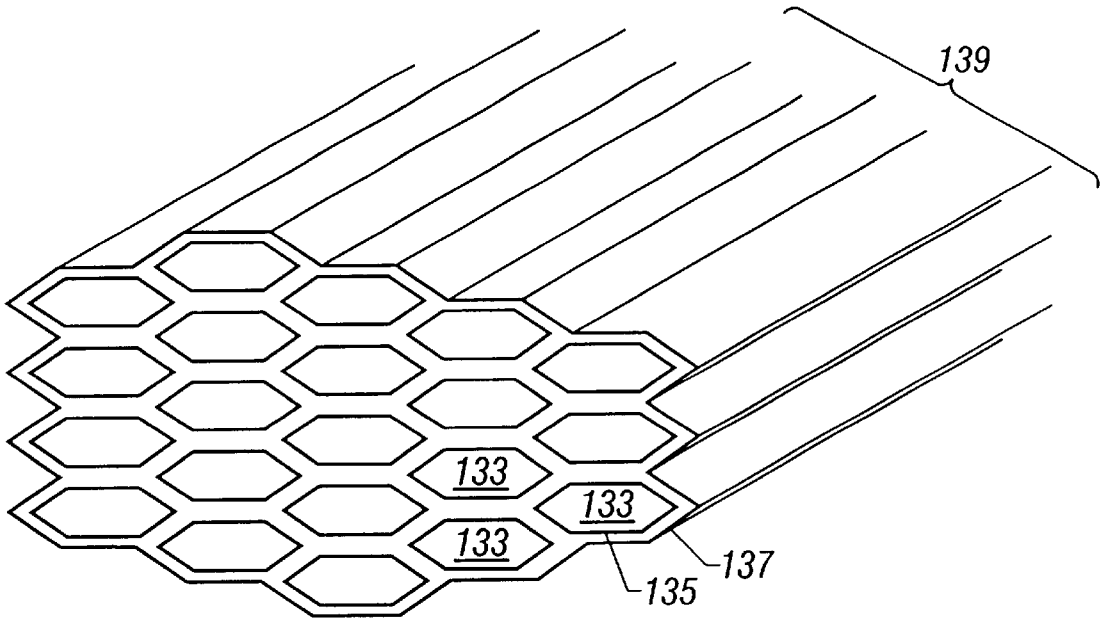
FIG. 11A is a perspective view of one embodiment of the composite construction material used in embodiments of the invention.

Referring to FIG. 11A, a first embodiment of the composite construction material includes a plurality of cased or coated fibers 133 that are bundled together. Each fiber 133 comprises a core 135 formed from a hard phase material such as polycrystalline diamond or polycrystalline cubic boron nitride. Each core 135 is surrounded by a shell or casing 137 formed from a binder phase material such as cobalt. The plurality of coated fibers 133 are oriented parallel to a common axis and are bundled together and extruded into a rod 139. This rod includes a cellular composite construction made up of binder phase material with hard phase material cores. These rods may be cut into small discs, and these discs may further be cut into the shape of the high-shear compaction tape 117 of FIG. 10 for use to manufacture the enhanced inserts in the above-described processes.

Figure 11B:
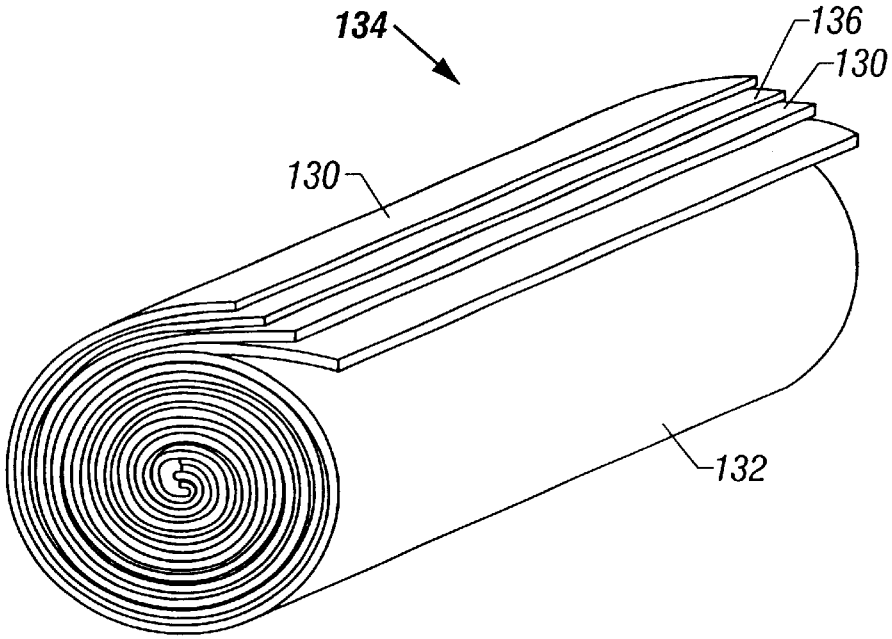
FIG. 11B is a perspective view of another embodiment of the composite construction material used in embodiments of the invention.

FIG. 11B illustrates another embodiment of the composite construction material. Referring to FIG. 11B, the composite construction material 134 includes a repeating arrangement of monolithic sheets 136 of a hard phase material and binder sheets 130 that are arranged to produce a swirled or coiled composite construction. The monolithic sheets 136 may be formed from polycrystalline diamond or polycrystalline cubic boron nitride, and the binder sheets 130 may be formed from a relatively ductile materials such as cobalt. Such a composite construction may be formed into a rod. Similar to the first embodiment, such rods may be cut into small discs for use in the manufacturing of the enhanced inserts.

It should be noted that, in some embodiments, the polycrystalline diamond layer is directly bonded to the tungsten carbide substrate. In other embodiments, one or more transition layers are placed between the polycrystalline diamond layer and the substrate to strengthen the bonding therebetween. Instead of or in addition to transition layers, an irregular interface (also referred to as "non-planar interface" by others in the art) between the polycrystalline diamond and the substrate may be employed. Various configurations of irregular interface are suitable. For example, U.S. Pat. No. 4,629,373 to Hall, entitled "Polycrystalline diamond Body With Enhanced Surface Irregularities" discloses various irregular interfaces.

The enhanced inserts according to embodiments of the invention have many applications. For example, it may be used in an earth-boring bit. Generally, an earth-boring bit includes a retention body (or a bit body) to support a plurality of inserts. The inserts are secured in the retention body and protrude from the surface of the retention body. The retention body may be either stationary or rotary while in use. The enhanced inserts may be used in such an earthboring bit. Specifically, a roller cone rock bit for petroleum or mining drilling may be constructed using the enhanced inserts.

Figure 12:
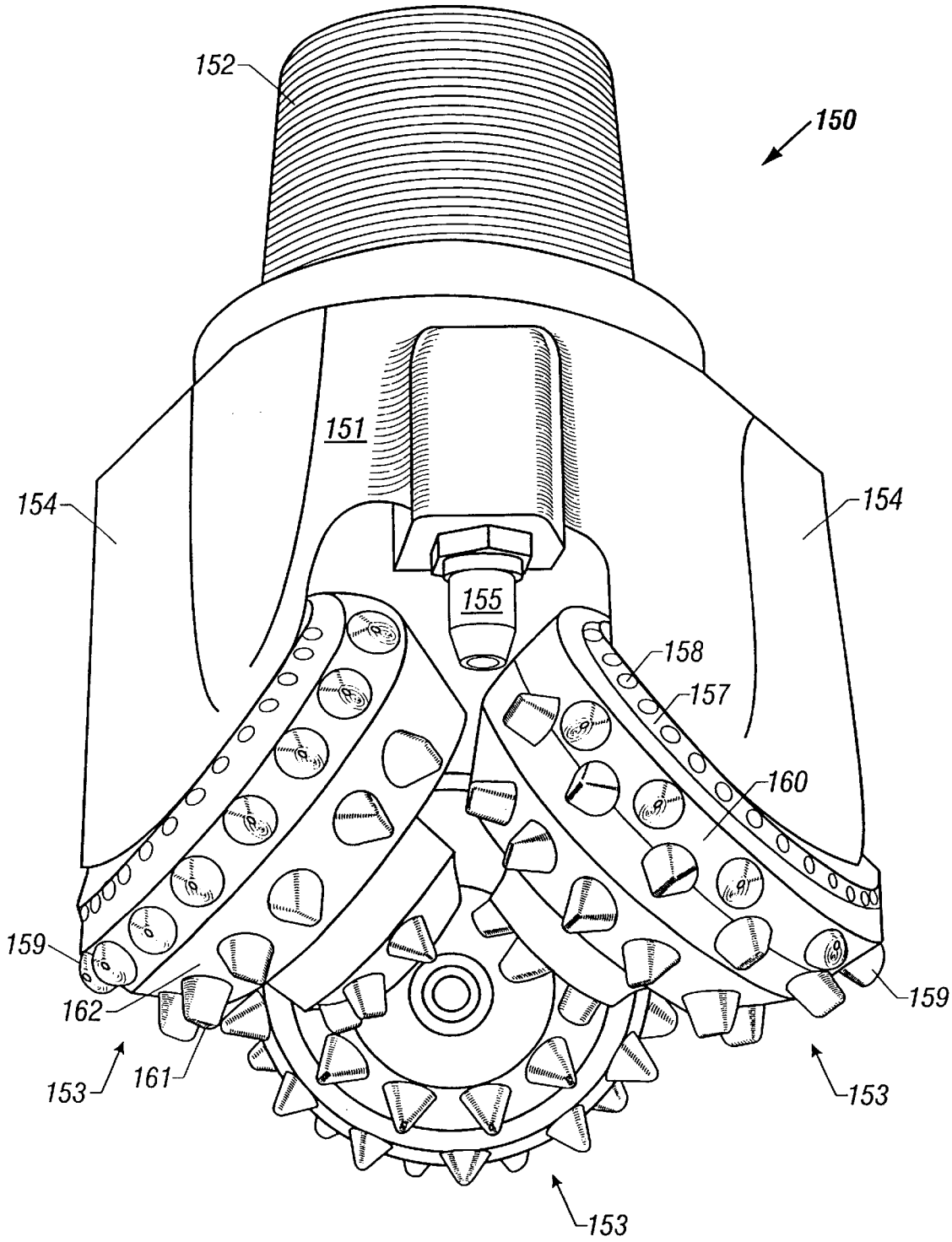
FIG. 12 is a perspective view of a rock bit manufactured in accordance with an embodiment of the invention.

FIG. 12 shows a perspective view of a rock bit constructed with the enhanced inserts according to embodiments of the invention. A rock bit 150 includes a bit body 151, having a threaded section 152 on its upper end for securing the bit to a drill string (not shown). The bit 150 generally has three roller cones 153 rotatably mounted on bearing shafts (hidden) that extend from the bit body 151. The bit body 151 is composed of three sections or legs 154 (two legs are shown) that are welded together to form the bit body. The bit 150 further includes a plurality of nozzles 155 that are provided for directing drilling fluid towards the bottom of a borehole and around the roller cones 153.

Generally, the roller cones 153 include a frustoconical surface 157 that is adapted to retain heel row inserts 158 that scrape or ream the side walls of a borehole as the roller cones rotate about the borehole bottom. The frustoconical surface 157 is referred to herein as the heel surface of the roller cone, although the same surface sometimes may be referred to by others in the art as the gage surface of the roller cone.

In addition to the heel row inserts 158 that are secured in a circumferential row of the frustoconical heel surface 157, the roller cone 153 further includes a circumferential row of gage inserts 159 secured to the roller cone in locations along or near the circumferential shoulder 160 that cut and ream the borehole corner wall to a full gage diameter. The roller cone 153 also includes a plurality of inner row inserts 161 secured to the roller cone surface 162 . These inner row inserts are usually arranged and spaced apart in respective rows. Optionally, a row of nestled gage inserts (not shown) may be disposed on the gage row between the gage row inserts 159. Furthermore, a row of off-gage inserts (not shown) also may be placed inwardly in the area away from the gage row 160. Generally, the inserts are not recessed in their respective insert holes. However, in some instances, the inserts may be recessed.

It is apparent that the enhanced inserts according to embodiments of the invention may be used as gage row inserts, off-gage inserts, nestled gage inserts, and inner row inserts. Although a petroleum rock bit is illustrated in FIG. 15, a mining rock bit may be manufactured in a similar manner. A mining rock bit is used to drill shallow holes with air being the drilling fluid.

As described above, embodiments of the invention provide an enhanced insert which may reduce and minimize the formation and propagation of localized chipping of a superhard material layer. An earth-boring bit incorporating such enhanced inserts should experience longer lifetime, higher total drilling footage and higher rate of penetration in operation. Other properties and advantages may be apparent to a person of ordinary skill in the art.

While the invention has been disclosed with respect to a limited number of embodiments, numerous modifications and variations therefrom are possible. For example, the enhanced insert may be used in any wear-resistant application, not just those described herein. Although the embodiments of the invention are described with respect to one continuous layer of superhard material in the secondary surface of the top portion, the polycrystalline diamond layer may be in the form of several discontinuous sections, and each section has a distinct composition of superhard material. Furthermore, the methods suitable for manufacturing the enhanced inserts are not limited to the high pressure and high temperature process. Any compaction method that bonds a layer of superhard material to a substrate may be employed. As to methods to practice the invention, they are not limited to the order of steps described herein. Any order which accomplishes the objects or results of the invention may be employed. While embodiments of the invention have been described with respect to a PCD enhanced insert, it should be noted that the invention equally applies to inserts that utilize polycrystalline boron nitride or other superhard materials. It is intended that appended claims cover all such modifications and their variations as fall within the true spirit and the scope of the invention.

What is claimed is:

1. A rock bit for drilling a borehole, comprising:

a bit body;

a roller cone rotatably mounted on the bit body;

a plurality of main cutting inserts located on the roller cone to cut at least a portion of the corner or bottom of the borehole, at least one main cutting insert comprising:

a body portion secured in the roller cone;

a top portion extending from the roller cone, the top portion including a substrate and having an outer lateral face, the outer lateral face having a central region; and a layer of superhard material provided over at least a portion of the substrate, but not in the central region of the outer lateral face.

2. The rock bit of claim 1, wherein the outer lateral face further includes a peripheral region, and the layer of superhard material extends to at least a portion of the peripheral region of the outer lateral face.

3. The rock bit of claim 1, wherein the top portion further includes a secondary surface, and the layer of superhard material is provided over at least a portion of the substrate in the secondary surface.

4. The rock bit of claim 3, wherein the top portion further includes a peripheral region in the outer lateral face, and the layer of superhard material is provided over at least a portion of the substrate in the peripheral region.

5. The rock bit of claim 1, wherein the outer lateral face is convex.

6. The rock bit of claim 1, wherein the outer lateral face is non-planar.

7. The rock bit of claim 1, wherein the outer lateral face is planar.

8. The rock bit of claim 1, wherein the outer lateral face is multifaceted.

9. The rock bit of claim 1, wherein the outer lateral face includes a centroid located in the central region of the outer lateral face.

10. The rock bit of claim 1, wherein the top portion includes a leading edge, a leading face, a crest, a trailing edge, a trailing face, and an inner end, and the layer of superhard material is provided over at least a portion of the substrate in the leading edge, leading face, the crest, the trailing edge, the trailing face, and the inner end.

11. The rock bit of claim 1, wherein the superhard material includes diamond.

12. The rock bit of claim 1, wherein the superhard material includes boron nitride.

13. The rock bit of claim 1, wherein the superhard material includes diamond particles and a metal selected from the group consisting of cobalt, nickel, iron, and alloys thereof.

14. The rock bit of claim 13, wherein the superhard material further includes particles of carbide or carbonitride of elements selected from the group consisting of tungsten, titanium, tantalum, chromium, molybdenum, vanadium, hafnium, zirconium, and alloys thereof.

15. The rock bit of claim 1, wherein the superhard material is recessed in the substrate.

16. The rock bit of claim 1, wherein the superhard material protrudes from the substrate.

17. The rock bit of claim 1, wherein the top portion is substantially chisel-shaped.

18. The rock bit of claim 1, wherein the top portion is substantially hemispherical.

19. The rock bit of claim 1, wherein the top portion is substantially asymmetrical.

20. The rock bit of claim 1, wherein the insert is a shaped insert.

21. The rock bit of claim 1, wherein the body portion of the insert is formed of a carbide composition.

22. The rock bit of claim 1, wherein the substrate of the insert is formed of a carbide composition.

23. The rock bit of claim 1, wherein the top portion includes a transition layer between the substrate and the layer of superhard material.

24. The insert of claim 23, wherein the transition layer includes diamond particles and tungsten carbide particles.

25. The rock bit of claim 1, wherein the top portion includes a plurality of transition layers between the substrate and the layer of superhard material.

26. The rock bit of claim 1, wherein the top portion includes an irregular interface between the substrate and the layer of superhard material.

27. The rock bit of claim 4, wherein the layer of superhard material in the secondary surface and the peripheral region of the outer lateral face completely surrounds the central region of the outer lateral face.

28. The rock bit of claim 1, wherein the roller cone includes a gage row, and the insert is located in the gage row to cut a portion of the corner of the borehole.

29. The rock bit of claim 1, wherein the roller cone includes an off-gage row, and the insert is located in the off-gage row to cut a portion of the corner of the borehole.

30. The rock bit of claim 1, wherein the roller cone includes a nestled gage row, and the insert is located in the nestled gage row to cut a portion of the corner of the borehole.

31. The rock bit of claim 1, wherein the roller cone includes an inner row, and the insert is located in the inner row to cut the bottom of the borehole.

32. The rock bit of claim 1, wherein a cutting edge of superhard material is formed in the outer lateral face when a portion of the substrate in the central region of the outer lateral face is worn away.

33. The rock bit of claim 32, wherein the cutting edge substantially surrounds the central region of the outer lateral face.

34. The rock bit of claim 33, wherein the cutting edge is circular.

35. The rock bit of claim 1, wherein the superhard material disposed on said main cutting insert also substantially cuts the full gage diameter of the borehole.

36. The rock bit of claim 1, wherein the substrate disposed on said main cutting insert also substantially cuts the full gage diameter of the borehole.

37. A rock bit, comprising:

a bit body;

a roller cone rotatably mounted on the bit body;

a plurality of main cutting inserts located on the roller cone to cut at least a portion of the corner or bottom of the borehole, at least one main cutting insert comprising:

a body portion secured in the roller cone;

a top portion extending from the roller cone, the top portion including a substrate and an outer lateral face, the outer lateral face comprising a central region and a peripheral region, wherein the central region is substantially free of superhard material and at least a portion of the peripheral region comprises superhard material.

38. The rock bit of claim 37, wherein the central region is substantially formed of tungsten carbide.

39. The rock bit of claim 37, herein the superhard material is polycrystalline diamond.

40. The rock bit of claim 37, wherein the portion substantially free of superhard material is formed of a material with a hardness that is at least 500 Vickers lower than the superhard material.

41. The rock bit of claim 40, wherein the top portion includes a secondary surface, and the superhard material is provided on at least a portion of the substrate in the secondary surface.

42. The rock bit of claim 40, wherein the portion substantially free of superhard material is formed of a non-superhard composite containing tungsten carbide and polycrystalline diamond.

43. The rock bit of claim 1, wherein the portion substantially free of superhard material is formed of a material with a hardness that is at least 500 Vickers lower than the superhard material.

44. The rock bit of claim 43, wherein the top portion includes a secondary surface, and the superhard material is provided on at least a portion of the substrate in the secondary surface.

45. The rock bit of claim 43, wherein the portion substantially free of superhard material is formed of a non-superhard composite containing tungsten carbide and polycrystalline diamond.

46. A rock bit comprising:

a bit body having a leg;

a roller cone rotatably mounted on the leg, the roller cone having a gage row and an inner row;

a plurality of main cutting inserts located on the gage row and the inner row of the roller cone, at least one main cutting insert comprising:

a substantially cylindrical body portion secured in the roller cone;

a top portion integral with the body portion and extending from the roller cone, the top portion including a cemented tungsten carbide substrate, the top portion having an outer lateral face and a secondary surface; and a continuous layer of polycrystalline diamond provided over the entire substrate in the secondary surface, wherein the substrate forming the outer lateral face is substantially free of superhard material.

47. The rock bit of claim 46, wherein the roller cone further includes a nestle gage row, and the one main cutting insert is located on the nestle gage row.

48. The rock bit of claim 46, wherein the roller cone further includes an off-gage row, and the one main cutting insert is located on the off-gage row.

* * * * *